US012121125B2

(12) United States Patent
Epicureo et al.

(10) Patent No.: US 12,121,125 B2
(45) Date of Patent: Oct. 22, 2024

(54) ITEM OF LUGGAGE PROVIDED WITH A VACUUM STORAGE BAG

(71) Applicant: CIE EUROPE, Lomme (FR)

(72) Inventors: Giulio Epicureo, Barcelona (ES); César Epicureo, Barcelona (ES)

(73) Assignee: CIE EUROPE, Lomme (FR)

( * ) Notice: Subject to any disclaimer, the term of this patent is extended or adjusted under 35 U.S.C. 154(b) by 0 days.

(21) Appl. No.: 17/624,946

(22) PCT Filed: Jul. 7, 2020

(86) PCT No.: PCT/EP2020/069066
§ 371 (c)(1),
(2) Date: Jan. 5, 2022

(87) PCT Pub. No.: WO2021/008932
PCT Pub. Date: Jan. 21, 2021

(65) Prior Publication Data

US 2022/0287428 A1 Sep. 15, 2022

(30) Foreign Application Priority Data

Jul. 17, 2019 (FR) ..... 1908046

(51) Int. Cl.
*A45C 13/02* (2006.01)
*A45C 5/03* (2006.01)
(Continued)

(52) U.S. Cl.
CPC ..... *A45C 13/02* (2013.01); *A45C 5/03* (2013.01); *A45C 5/14* (2013.01);
(Continued)

(58) Field of Classification Search
CPC .. A45C 13/02; A45C 5/03; A45C 5/14; A45C 2005/037; A45C 2013/026; A45C 2013/028; A45C 2013/1015
See application file for complete search history.

(56) References Cited

U.S. PATENT DOCUMENTS 4,569,082 A * 2/1986 Ainsworth ..... A45C 13/021 383/110
7,311,200 B2 * 12/2007 Godshaw ..... B25H 3/02 206/373

(Continued)

FOREIGN PATENT DOCUMENTS

GB 2410736 8/2005

OTHER PUBLICATIONS

International Search Report and Written Opinion for PCT/EP2020/069066 mailed Sep. 25, 2020.

*Primary Examiner* — Tri M Mai
(74) *Attorney, Agent, or Firm* — Workman Nydegger

(57) ABSTRACT

The invention relates to an item of luggage comprising a shell composed of a first half-shell and a second half-shell, at least two casters, each of the casters being mounted on a support, the first half-shell comprising two housings for taking up the caster supports, the item of luggage further comprising a vacuum storage device placed in the first half-shell, the vacuum storage device comprising a stiffening plate, a bag having a main compartment, a sealing device for sealing the main compartment, and a non-return valve arranged so as to block the air intake in the main compartment and allow air to exit from the bag when the main compartment is sealed, and a fastening device for detachably fastening the vacuum storage device to the first half-shell.

9 Claims, 6 Drawing Sheets

(51) Int. Cl.
*A45C 5/14* (2006.01)
*A45C 13/10* (2006.01)

(52) U.S. Cl.
CPC .. *A45C 2005/037* (2013.01); *A45C 2013/026* (2013.01); *A45C 2013/028* (2013.01); *A45C 2013/1015* (2013.01)

(56) References Cited

U.S. PATENT DOCUMENTS

| | | | | |
|---|---|---|---|---|
| 8,210,353 | B2 * | 7/2012 | Epicureo | B65D 85/18 206/524.8 |
| 9,060,577 | B2 * | 6/2015 | Farrelly | A45C 13/103 |
| 9,961,974 | B2 * | 5/2018 | Hillaert | A45C 5/14 |
| 10,376,031 | B1 * | 8/2019 | Majhess | A45C 13/02 |
| 10,609,996 | B2 * | 4/2020 | Gregory | A45F 3/04 |
| 10,660,416 | B2 * | 5/2020 | Paul | A45C 13/262 |
| 11,019,888 | B2 * | 6/2021 | Newson | A45C 5/03 |
| 2005/0155891 | A1 * | 7/2005 | Chen | B65D 5/46016 206/524.8 |
| 2005/0173439 | A1 * | 8/2005 | Chen | B65D 77/06 220/495.06 |
| 2009/0080809 | A1 | 3/2009 | Calvo et al. | |
| 2013/0220755 | A1 * | 8/2013 | Meersschaert | A45C 13/26 190/18 A |
| 2013/0292221 | A1 | 11/2013 | Ryan et al. | |
| 2017/0049201 | A1 * | 2/2017 | Moreau | A45F 5/021 |

* cited by examiner

[Fig. 1]
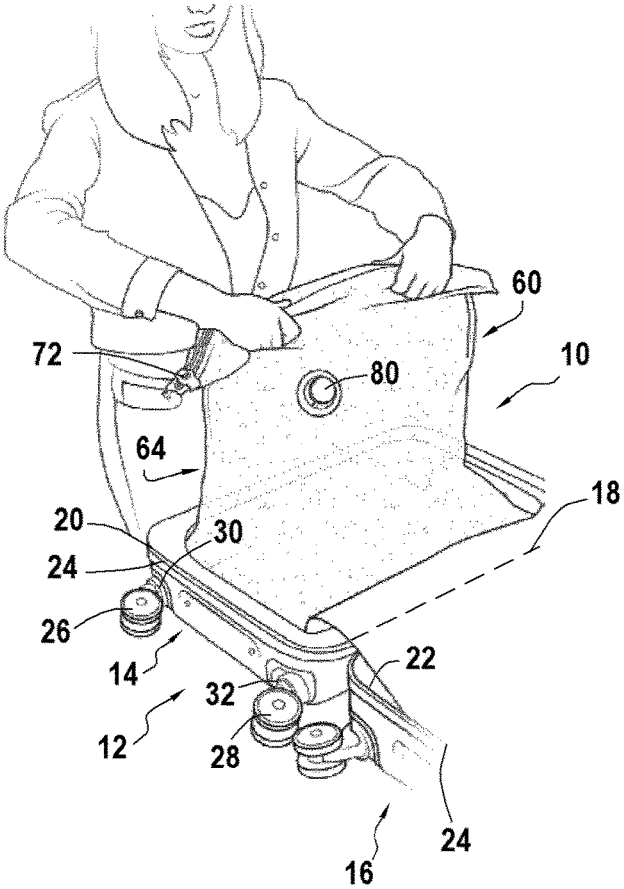
[Fig. 2]
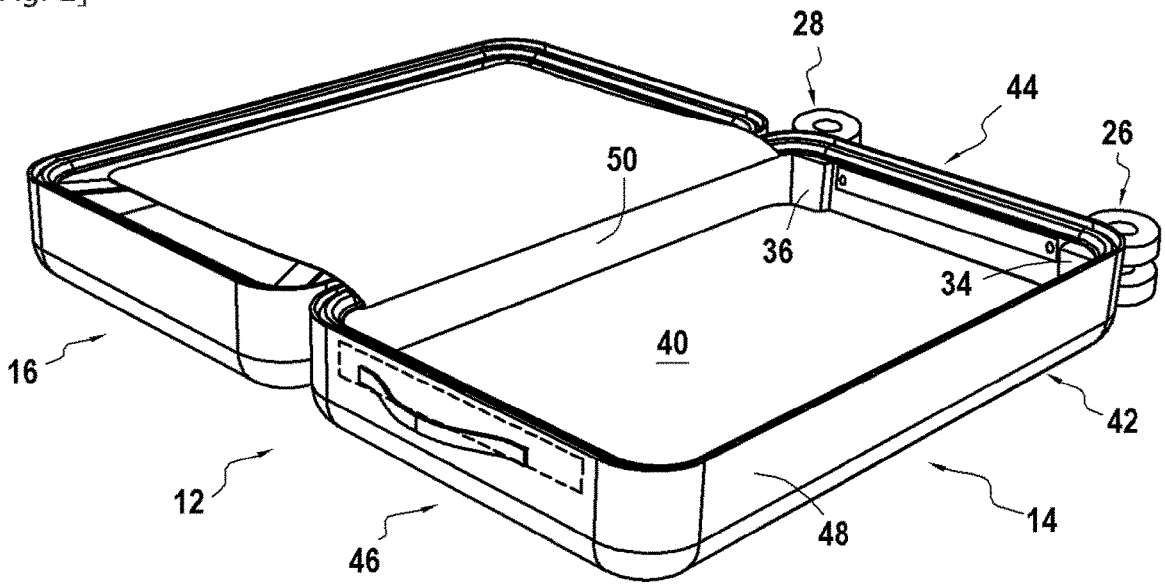

[Fig. 3]
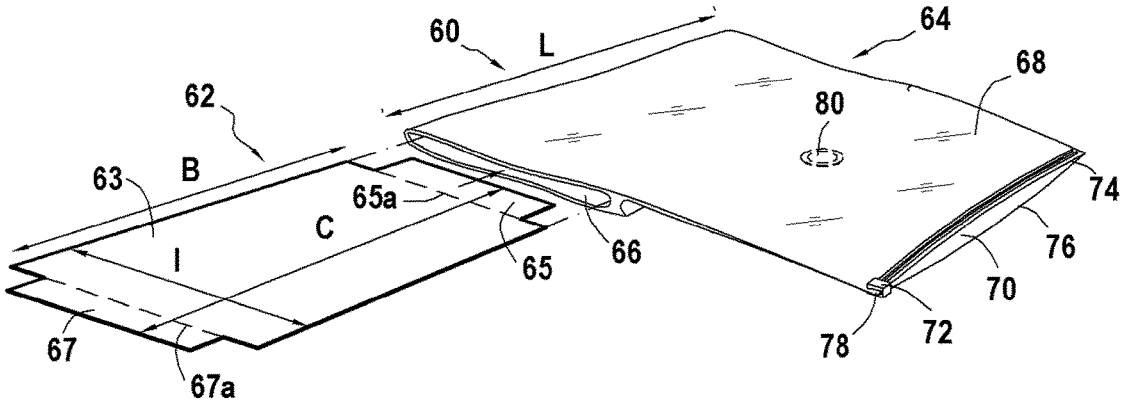
[Fig. 4]
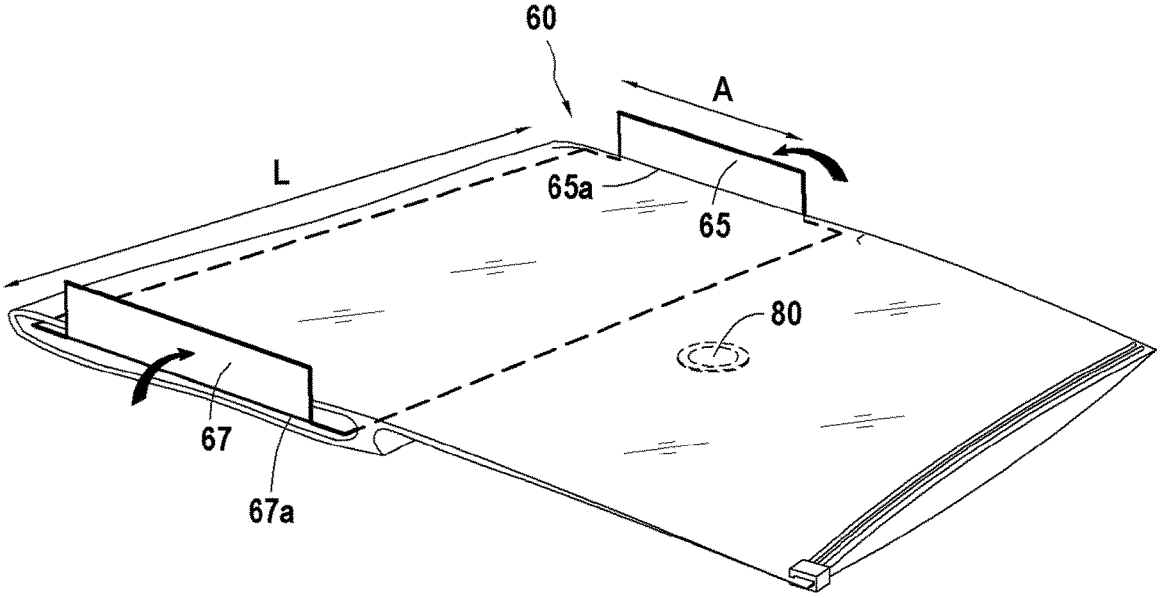

[Fig. 5]
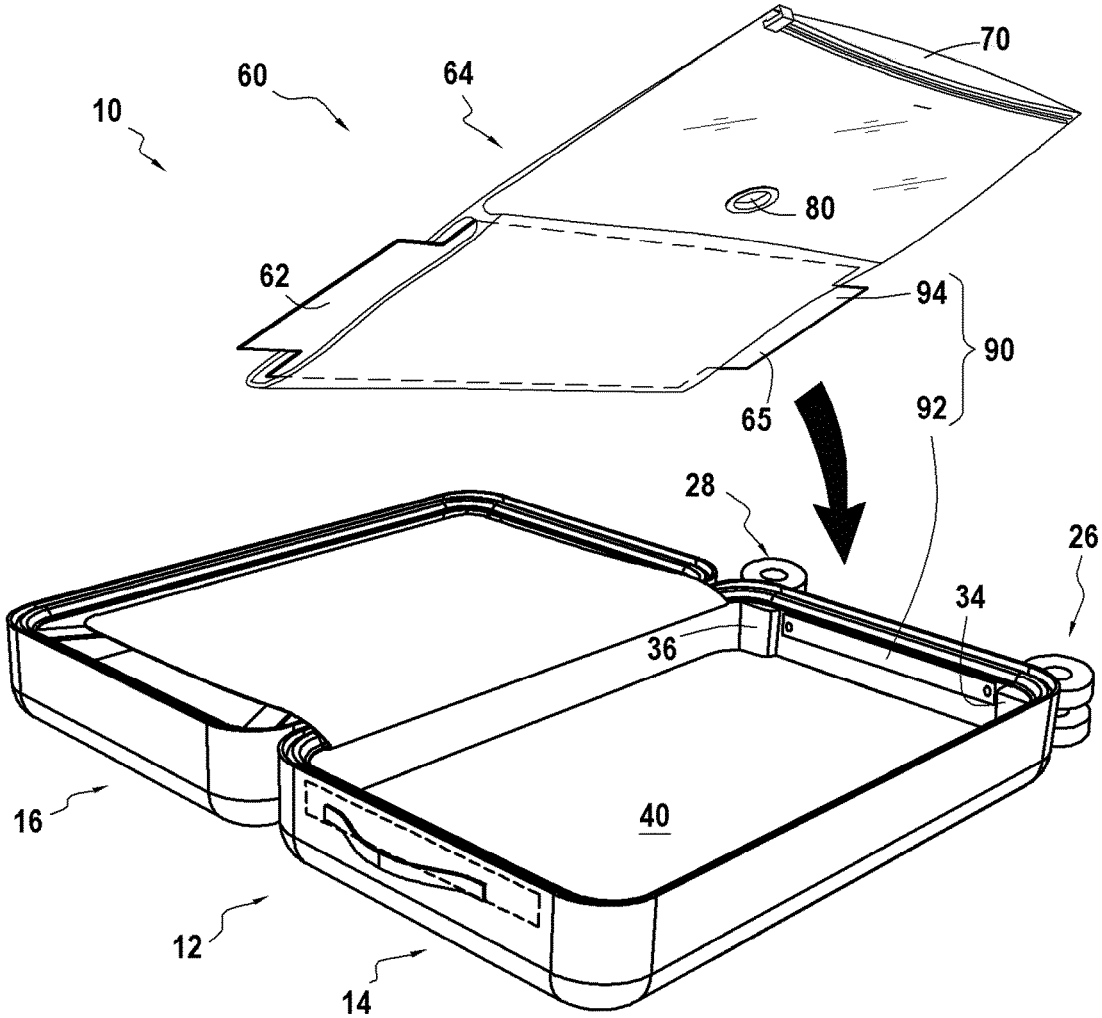

[Fig. 6]
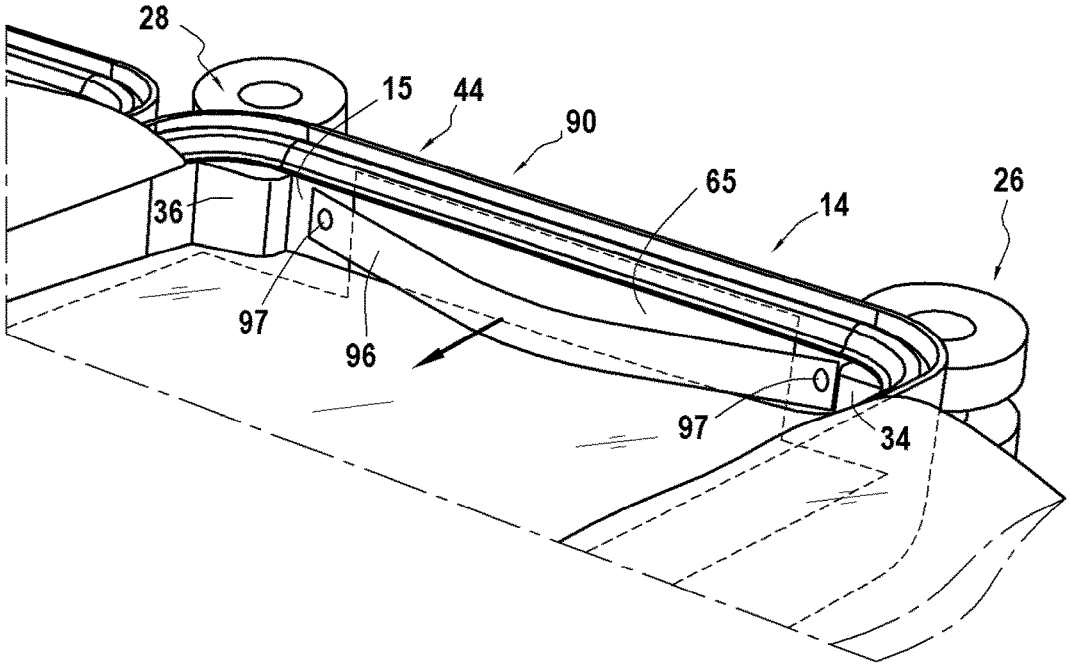
[Fig. 7]
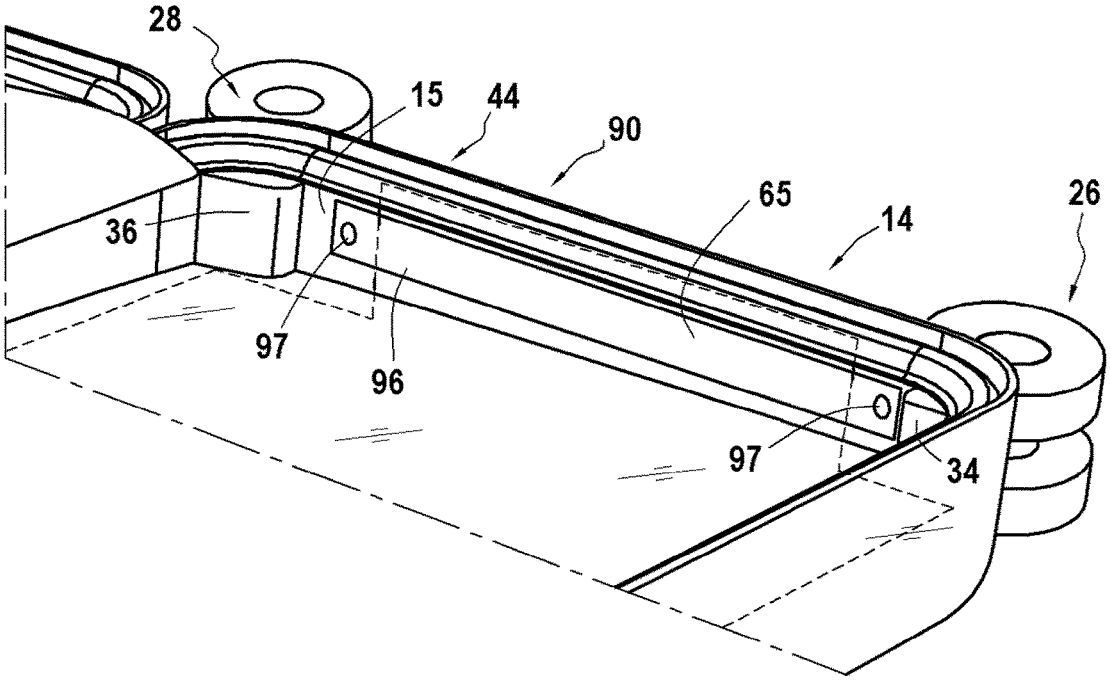

[Fig. 8]
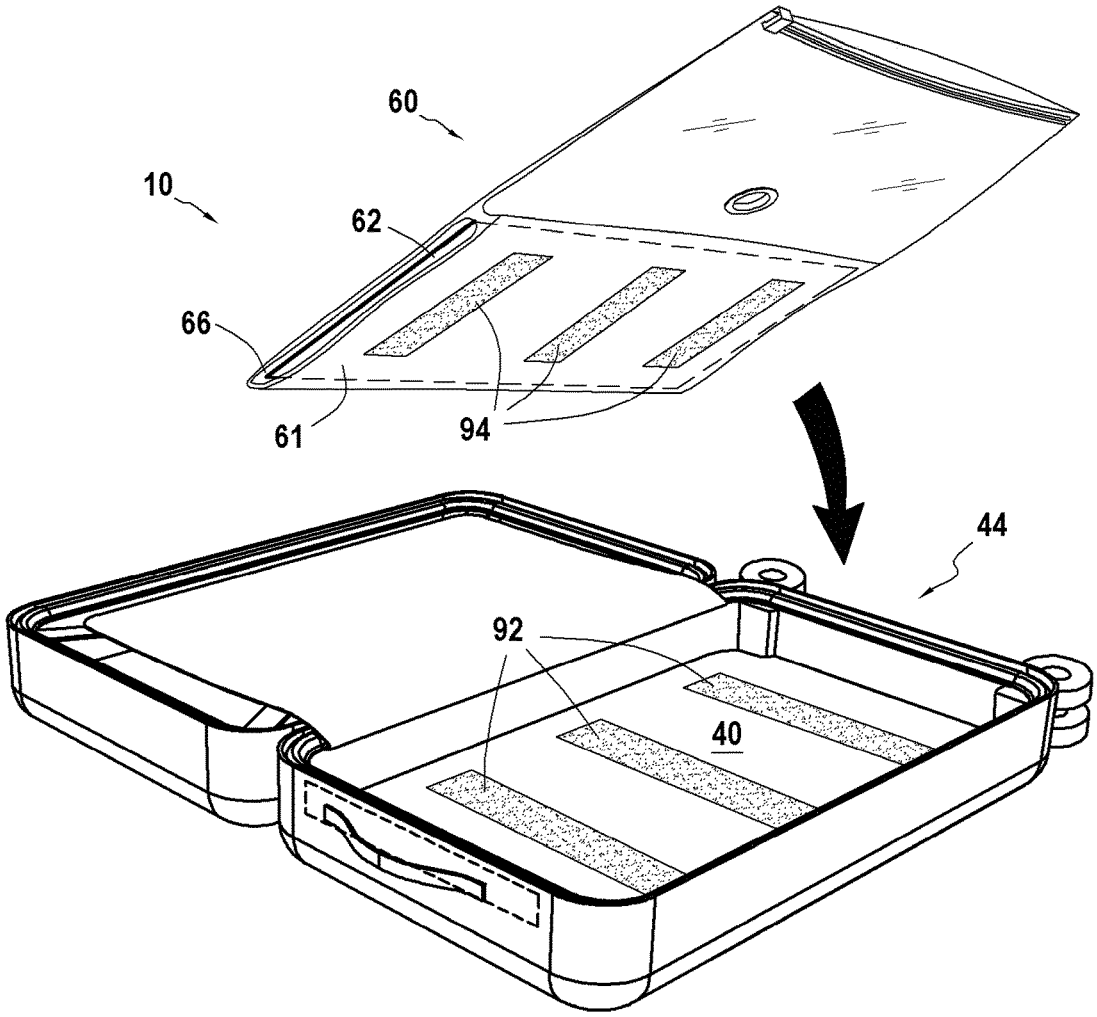

[Fig. 9]
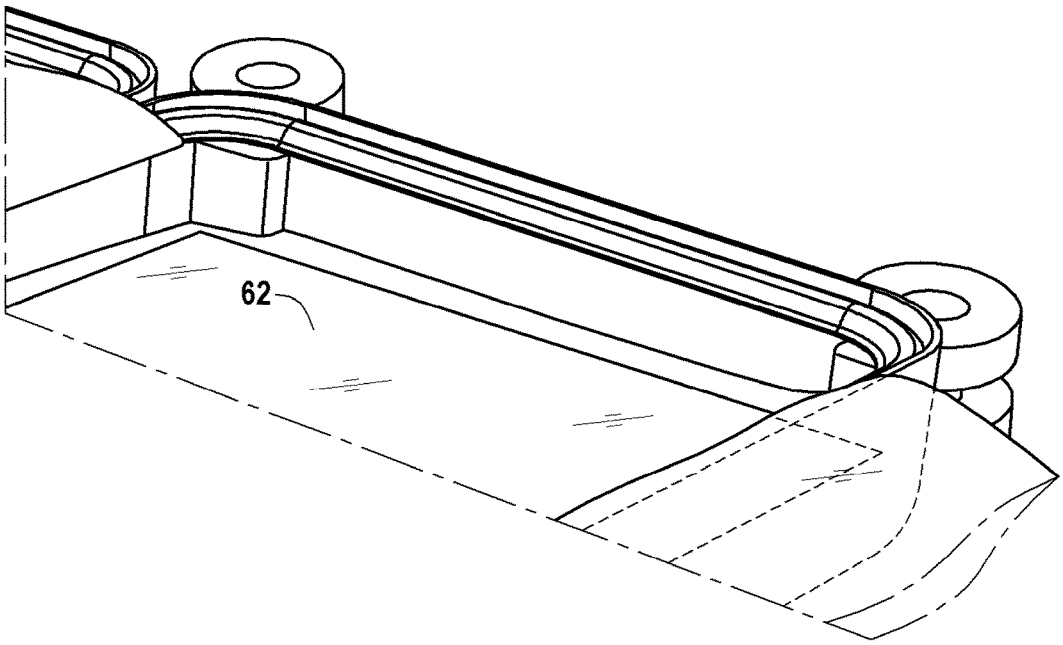

ITEM OF LUGGAGE PROVIDED WITH A VACUUM STORAGE BAG

CROSS-REFERENCE TO RELATED APPLICATIONS

The present application is a 371 US Nationalization of PCT Patent Application No. PCT/EP2020/069066, filed Jul. 7, 2020, which claims priority to French Patent Application No. 1908046, filed Jul. 17, 2019, the disclosure of each of which is hereby incorporated by reference in its entirety.

TECHNICAL FIELD

The present invention relates to the field of luggage and especially hand luggage, also called cabin baggage, allowed in an aircraft cabin.

PRIOR ART

One well-known type of luggage used by travellers is hand luggage, also called cabin baggage.

Traditionally, such hand luggage comprises a shell composed of a first half-shell and a second half-shell, the first and second half-shells being pivotingly mounted to each other, the hand luggage comprising a closing device for holding the first and second half-shells against each other so as to close the shell. This type of luggage comprises at least two casters, each of the casters being mounted on a support, the first half-shell comprising two housings for taking up the caster supports.

The shell can be made of plastic, metal or textile.

The advantage of the hand luggage is that the traveller dispenses with the luggage weighing-in procedure, as a result of which he can embark and disembark faster than the traveller who has to weigh in his luggage prior to embarking, and retrieve it on arrival from the baggage carousel at the airport.

But hand luggage has reduced dimensions, the standard size of cabin baggage as defined by the International Air Transport Association (IATA) being 55×35×20 cm.

The volume of items transportable via cabin baggage is therefore low, substantially limiting the usage of such luggage.

Document US 2013/292221 describes an item of luggage comprising a vacuum storage device placed in the first half-shell, the vacuum storage device comprising a bag having a main compartment fitted with an opening, a sealing device for sealing the main compartment, and a non-return valve arranged so as to block the air intake in the main compartment and allow air to exit from the bag when the main compartment is sealed, and the item of luggage further comprises a fastening device for detachably fastening the vacuum storage device to the first half-shell.

However, it has a complex and costly structure.

Presentation of the Invention

An aim of the present invention is to propose an item of luggage, hand luggage for example, for transporting more items than traditional luggage of the same size and having a structure less complex than the item of luggage of document US 2013/292221.

The invention achieves its aim by the fastening device comprising a first fastening member and a second fastening member, the first half-shell comprising the first fastening member while the vacuum storage device comprises the second fastening member, the first and second fastening members being arranged to cooperate with each other so as to attach the storage device to the first half-shell, the vacuum storage device further comprising a stiffening plate comprising a body and at least one first end section which is inclinable relative to the body, and the first fastening member comprises at least one first holding element cooperating with the first end section so as to maintain the stiffening plate relative to the first half-shell.

It is evident that the user can place device bulky items in the storage, for example ski clothing, and can reduce the volume by removing the air contained in the main compartment of the bag. To do this, the user closes the main compartment of the bag by means of the sealing device then exerts pressure on the closed bag, resulting in forcing out air via the non-return valve. After the user has compressed the items, they now have reduced volume and do not go back to their normal volume as long as the bag has not been opened. Since the items are less bulky in their compressed state, it is therefore possible to put more items in the item of luggage according to the invention than in a classic item of luggage of the same size.

In addition, the fastening device ensures that the bag stays positioned correctly in the first half-shell while the user inserts items into the main compartment, but also during the subsequent step of compressing the bag.

The placing of items in the bag and compression of the latter is therefore carried out while the storage device is in the first half-shell. One of the advantages of the invention is that the compressed items assume the form of the first half-shell during compression, which maximises the volume occupied by the compressed items in the first half-shell. The first half-shell is advantageously rigid and does not deform during placing of the items or their compression in the latter.

The fastening device allows detachable fastening, and as a result it is easily possible to replace the storage device if needed.

Because of the invention, the user can quickly and correctly position the vacuum storage device in the first half-shell by engaging the second fastening member with the first fastening member.

It is evident that the stiffening plate is held by the first holding element, ensuring the vacuum storage device is held relative to the shell. The body of the plate is placed between the first holding element and the base wall of the first half-shell, while the first end section is engaged in between the first holding element and the first lateral wall of the first half-shell, the first end section being substantially orthogonal to the body of the plate.

Preferably, the stiffening plate is fastened to the bag. More preferably, the bag comprises a secondary compartment, placed between the main compartment and the shell, the stiffening plate being lodged in said secondary compartment.

According to an embodiment, the first half-shell has an inner wall covered with a protective fabric, and the first fastening member is secured to said protective fabric.

This protective fabric constitutes a cleanliness layer for preventing the vacuum storage device making direct contact with the inner wall of the first half-shell. The protective fabric also masks the housings taking up the caster supports which extend inside the half-shell.

According to another variant, the first fastening member is secured to the wall of the first half-shell.

Preferably, the fastening device further comprises a second holding element, secured to the first half-shell—or the protective fabric—and placed on the opposite wall. This second holding element is configured to cooperate with a second end section of the stiffening plate, opposite the first end section.

In this embodiment, the storage device is therefore held at least by the first holding element cooperating with the first end section of the stiffening plate, and preferably by the first and second holding elements cooperating with the first and second end sections of the stiffening plate.

Preferably, the body extends over a base wall of the first half-shell, while the first end section extends according to a lateral wall of the first half-shell, and the first holding element is placed on the first lateral wall. The body of the stiffening plate is placed between the first and second holding elements on the one hand and the base wall on the other hand, improving the way the bag is held in the first half-shell.

Another interesting feature is that the storage device can be wedged at least against a lateral wall of the first half-shell, preferably against opposite lateral walls, which prevents the storage device from moving loosely in the first half-shell.

Preferably, though not necessarily, the first holding element is secured to the protective fabric.

More preferably, the first holding element is an elastic band. A point of interest here is to make it easy to place and withdraw the bag. The first end section is held between the first holding element and the first lateral wall.

Preferably, the body of the stiffening plate is placed in the secondary compartment, while the first end section extends from the secondary compartment.

According to an advantageous embodiment, the two housings project from the lateral wall towards the interior of the first half-shell, and the first end section has a length equal to or slightly less than the distance separating the two housings such that the first end section engages in between the two housings.

The effect of this mounting is that the first end section is held between the housings. A point of interest is to further improve the stable positioning of the stiffening plate in the first half-shell.

Preferably, the width of the body is greater than the length of the first end section. According to a preferential configuration, the longitudinal edges of the body are supported or at the very least are near the walls of edges of the first half-shell, these edge walls being orthogonal to the lateral wall, further improving the positioning and holding of the storage device of the first half-shell.

According to another embodiment of the invention, the vacuum storage device comprises a stiffening plate which is placed between the second fastening member and the main compartment. Preferably, the first fastening member is then located on a base wall of the first half-shell.

Advantageously the stiffening plate is placed in a secondary compartment of the storage device and the second fastening member is fastened to a wall of the secondary compartment.

This secondary compartment is preferably placed below the main compartment. The first fastening device is per se preferably fastened to the protective fabric when it is present.

This installation ensures proper holding of the stiffening plate against the base wall of the first half-shell.

According to an embodiment, the first and second fastening members comprise a fastening system of loops/hooks type.

The first fastening member can be fastened to the protective fabric or directly to the wall of the first half-shell, while the second fastening member is secured to the wall of the secondary compartment taking up the stiffening plate.

According to another advantageous aspect the item of luggage further comprises a device for creating a vacuum, preferably lodged in a pocket of the item of luggage.

The item of luggage is preferably an item of cabin baggage.

It preferably further comprises a telescopic prehension member mounted on the first half-shell of the shell. This prehension member can further comprise a handle for handling the item of luggage. Also, the second half-shell can comprise casters.

BRIEF DESCRIPTION OF THE DRAWINGS

The invention will be better understood from the following description of embodiments of the invention given by way of non-limiting examples in reference to the appended drawings, in which:

FIG. 1 illustrates an item of luggage according to the present invention, prior to compression of the items contained in the bag;

FIG. 2 illustrates the storage device according to a first embodiment of the invention, showing insertion of the stiffening plate into its housing;

FIG. 3 illustrates the end sections of the stiffening plate of FIG. 2, in folded position;

FIG. 4 illustrates the shell of the item of luggage according to the first embodiment, in open position, without the storage device;

FIG. 5 illustrates the placing of the storage device into the first half-shell of the shell of FIG. 4;

FIG. 6 is a detailed view of the engagement of one of the end sections of the stiffening plate with the elastic band;

FIG. 7 shows one of the end sections being held by the elastic band;

FIG. 8 illustrates a second embodiment of the item of luggage according to the invention, the fastening device comprising a loop and hook system; and FIG. 9 illustrates the item of luggage of FIG. 8, after placing of the storage device into the first half-shell.

DETAILED DESCRIPTION

FIG. 1 illustrates an item of luggage 10, of hand cabin luggage type, which comprises a shell 12 composed of a first half-shell 14 and a second shell 16. As is also known, the first and second half-shells 14, 16 are pivotingly mounted to each other along a common edge 18 illustrated in dots in FIG. 1. The first and second half-shells 14, 16 each comprise a peripheral free edge, these two peripheral free edges 20, 22 being supported against each other when the shell is in closed position. Without departing from the scope of the present invention however, the item of luggage could be larger in size, and be placed in the luggage hold.

As is known, the item of luggage 10 further comprises a closing device 24, for example a zipper which comprises two complementary sections each extending along the peripheral edges 20, 22 of the first and second half-shells.

It is evident that the function of the closing device 24 is to hold the first and second half-shells against each other so as to close the shell 12.

The item of luggage 10 also comprises first and second casters 26, 28 which are connected to the first half-shell 14. As illustrated in FIG. 1, it is noted that the second half-shell also comprises casters.

The first caster 26 is mounted on a first support 30, while the second caster 28 is mounted on a second support 32. The first half-shell also comprises a first receiving member 34 for taking up the first support 30, and a second receiving member 36 for taking up the second support 32.

These receiving members 34 and 36 are best seen in FIG. 2 which illustrates only the shell of the item of luggage 10.

As is clear in FIG. 2, the receiving members preferably have the form of casings which project inside the first half-shell 14.

As is known, the first caster (respectively the second caster) is mounted to rotate around its axis of rotation relative to the first support (respectively the second support), the first support (respectively the second support) being per se mounted rotatively relative to the first receiving member (respectively the second receiving member) around an axis of rotation which is perpendicular to the axis of rotation of the first caster (respectively the second caster).

The first and second receiving members therefore comprise means for holding the supports and allowing them to rotate around their axes of rotation.

The first and second receiving members therefore present a certain bulk to the extent where they project inside the volume of the first half-shell. This particular configuration is due to the fact that the first and second casters are to be placed nearest to the first half-shell 14.

As is known, the first and second receiving members 34, 36 are constituted by applied pieces which are connected to the first half-shell. The housings can also be defined by recesses of the first half-shell, especially when the latter is produced by moulding or extrusion.

As illustrated in FIG. 2, the first half-shell 14 comprises a base wall 40 and a peripheral wall 42 which encircles the base wall 40. The peripheral wall 42 is composed of a first lateral wall 44 from where the first and second casters 28 extend, a second lateral wall 46, opposite the first lateral wall 44, and two walls of parallel edge 48, 50 which extend according to the length of the first half-shell 14.

In keeping with the invention, the item of luggage 10 further comprises a vacuum storage device 60, illustrated in FIGS. 3 and 4, which is intended to be placed in the first half-shell 14. The placing of the vacuum storage device 60 in the first half-shell 14 is illustrated especially in FIGS. 5 to 7.

The vacuum storage device 60 comprises a stiffening plate 62, for example made of cardboard, as well as a bag 64 into which the user inserts the items to be compressed. The bag 64 comprises a main compartment 68 fitted with an opening 70 via which the items are introduced. The bag further comprises a secondary compartment 66 into which the stiffening plate 62 is placed. The bag comprises a sealing device 72 for sealing the main compartment 68.

In this example, and as is known, the sealing device 72 is constituted by the two end edges 74, 76 which delimit the opening, these two edges 74, 76 being provided with longitudinal grooves and ribs of complementary form which engage in each other due to the action of a slider 78 which is shifted according to the length of the end edges.

In the example of FIG. 3, the main compartment 68 is shown in its open state.

The vacuum storage device 60 further comprises a non-return valve 80 which is arranged so as to block off the air intake in the main compartment but allow air to exit from the bag when the main compartment is sealed.

In the example of FIG. 1, the user removes the air from the main compartment of the bag by rolling the bag up on itself. Without departing from the scope of the present invention, evacuating air from the bag can be done by means of a vacuum cleaner or a pump.

In keeping with the invention, the item of luggage 10 further comprises a fastening device 90 for detachably fastening the vacuum storage device 60 to the first half-shell 14.

In the embodiment illustrated in FIGS. 2 to 7, the stiffening plate 62 comprises a body 63, a first end section 65 which is inclinable relative to the body according to a fold line 65*a*. In this example, the fold line 65*a* extends according to the width I of the stiffening plate 62. The stiffening plate 62 further comprises a second end section 67, opposite the first end section 65, which is also inclinable relative to the body 63 according to a fold line 67*a* which extends according to the width of the stiffening plate 62.

As is clear from FIG. 1, the width I of the body 63 is greater than the length A of the first end section 65.

Also, the length B of the body 63 is substantially equal to the length L of the secondary compartment 66 such that, when the stiffening plate is placed in the secondary compartment 66, the first and second end sections 65 and 67 project from the secondary compartment 66. In FIG. 4, the first and second end sections in the form of wings 65, 67 extend substantially perpendicularly to the body 63 so as to flank the secondary compartment 66.

It is therefore clear that the total flat length of the stiffening plate, referenced C in FIG. 3, is greater than the length B of the body 63.

An embodiment of the fastening device 90 will now be explained in detail.

In the example of FIGS. 2 to 7, the fastening device 90, seen in FIGS. 5 and 6, comprises a first fastening member 92 which is placed in the first half-shell 14, and a second fastening member 94 which is secured to the vacuum storage device 60. As will be explained hereinbelow, the first and second fastening members 92, 94 are arranged to cooperate with each other so as to secure the storage device to the first half-shell 14.

The first fastening member 92 is secured to the inner wall 15 of the first half-shell 14.

In this example, the first fastening member 92 comprises a first holding element 96 which is constituted by an elastic band which extends between the first and second receiving members 34, 36. This elastic band is fastened to the first lateral wall or, if needed, to the protective fabric which covers it.

The first holding element is fastened to the peripheral wall 42 of the first half-shell for example by means of rivets 97 placed at each of the ends of the elastic band.

The second fastening member 94 comprises the first end section 65 described hereinabove. By way of FIG. 6 it is clear that when the storage device is installed in the first half-shell 14, the body 63 of the stiffening plate lodged in the secondary compartment 66 extends over the base wall 40 of the first half-shell 14, while the first end section 65 is substantially supported against the first lateral wall 44 of the first half-shell. The first holding element 96, placed on the first lateral wall 44 is arranged such that the first end section 65 is held by being sandwiched between the elastic band 96 and the first lateral wall 44. A second holding element, similar to the first holding element, is placed on the second lateral wall so as to cooperate with the second end section. As a consequence, the stiffening plate is held relative to the first half-shell 14. It is further noted that the body of the plate is located between the first and second holding elements and the base wall, such that the holding elements work against the bag being withdrawn from the first half-shell.

Also it is noted that the two receiving members 34, 36 in the form of casings, which project from the first lateral wall 44 towards the interior of the first half-shell, are placed on either side of the first holding element 96. In other words, the length A of the first end section 65 is less than the distance separating the two receiving members 34, 36 such that the first end section 65 engages in between the two receiving members.

FIGS. 8 and 9 illustrate a second embodiment of the item of luggage according to the invention.

In this second embodiment the stiffening plate 62 has a rectangular form so as to be fully lodged in the secondary compartment 66. But without departing from the scope of the present invention the stiffening plate could comprise end sections in the form of wings similar to those of the first embodiment.

In this second embodiment the first fastening member 92 is constituted by bands of Velcro® type fastened to the base wall 90 of the first half-shell 14. The second fastening member 94 is also constituted by additional Velcro® bands which are fastened to a face 61 of the secondary compartment 66, as illustrated in FIG. 9. When the first and second fastening members 92 and 94 are engaged in each other, the stiffening plate 62 is secured to the base wall 40 of the first half-shell 14, as illustrated in FIG. 10.

Without departing from the scope of the present invention, the fastening device 90 of the first embodiment could also be combined with that of the second embodiment.

The invention claimed is:

1. An item of luggage comprising a shell composed of a first half-shell and a second half-shell, the first and second half-shells being pivotingly mounted to each other, the first half-shell comprising a base wall and a peripheral wall surrounding the base wall perpendicularly, said peripheral wall having a first lateral wall, the item of luggage comprising:

a closing device for holding the first and second half-shells against each other so as to close the shell, at least two casters, each of the casters being mounted on a caster support, the first lateral wall comprising two casings for taking up the caster supports, the two casings projecting from the first lateral wall towards the inside of the first half-shell, a vacuum storage device placed in the first half-shell, the vacuum storage device comprising a bag having a main compartment fitted with an opening as well as a secondary compartment, a sealing device for sealing the main compartment, and a non-return valve arranged so as to block the air intake in the main compartment and allow air to exit from the bag when the main compartment is sealed, and a fastening device for detachably fastening the vacuum storage device to the first half-shell, the fastening device comprising a first fastening member and a second fastening member, the first and second fastening members being arranged to cooperate with each other so as to attach the storage device to the first half-shell, the first fastening member comprising a first holding element located on the first lateral wall and extending at least a major portion between the two casings, while the vacuum storage device comprises the second fastening member, wherein the vacuum storage device further comprises a stiffening plate placed in the secondary compartment, said stiffening plate comprising a body extending over the base wall and at least one first end section which is inclined relative to the body along a fold line extending along a width of the body, the first end section being the second fastening member and having a length which is less than the width of the body and less than the distance separating the two casings such that the first end section extends over the first lateral wall between the two casings, said first end section being sandwiched between the first holding element and the first lateral wall so that the stiffening plate is fastened to the first half-shell.

2. The item of luggage according to claim 1, wherein the first holding element is an elastic band.

3. The item of luggage according to claim 1, wherein the first fastening member comprises a second holding element cooperating with a second end section of the plate, opposite to the first end section.

4. The item of luggage according to claim 1, further comprising a vacuum device.

5. The item of luggage according to claim 1, wherein the first fastening member is secured to the inner wall of the first half-shell.

6. The item of luggage according to claim 1, the first half-shell having an inner wall covered with a protective fabric, and the first fastening member being secured to said protective fabric.

7. The item of luggage according to claim 1, wherein a length of the first holding element is greater than the length of the first end section.

8. An item of luggage comprising a shell composed of a first half-shell and a second half-shell, the first and second half-shells being pivotingly mounted to each other, the item of luggage comprising:

a closing device for holding the first and second half-shells against each other so as to close the shell, at least two casters, each of the casters being mounted on a support, the first half-shell comprising two housings for taking up the caster supports, a vacuum storage device placed in the first half-shell, the vacuum storage device comprising a bag having a main compartment fitted with an opening, a sealing device for sealing the main compartment, and a non-return valve arranged so as to block the air intake in the main compartment and allow air to exit from the bag when the main compartment is sealed, and a fastening device for detachably fastening the vacuum storage device to the first half-shell, the fastening device comprising a first fastening member being on the base wall of the first half-shell, and a second fastening member secured to the vacuum storage device, the first and second fastening members being arranged to cooperate with each other so as to attach the storage device to the first half-shell;

wherein the vacuum storage device further comprises a stiffening plate placed between the second fastening member and the main compartment, the stiffening plate being placed in a secondary compartment of the bag and wherein the second fastening member is on a bottom wall of the secondary compartment facing the base wall of the first half-shell, said stiffening plate has substantially the same area as the bottom of the vacuum storage device, without any folding, wherein the first and second fastening members comprise a fastening system of loops/hooks type.

9. An item of luggage comprising a shell composed of a first half-shell and a second half-shell, the first and second half-shells being pivotingly mounted to each other, the first half-shell comprising a base wall and a peripheral wall surrounding the base wall perpendicularly, said peripheral wall having a first lateral wall, the item of luggage comprising:

a closing device for holding the first and second half-shells against each other so as to close the shell, at least two casters, each of the casters being mounted on a caster support, the first half-shell comprising two housings for taking up the caster supports, the two housings projecting from the lateral wall towards the interior of the first half-shell, a vacuum storage device placed in the first half-shell, the vacuum storage device comprising a bag having a main compartment fitted with an opening, a sealing device for sealing the main compartment, and a non-return valve arranged so as to block the air intake in the main compartment and allow air to exit from the bag when the main compartment is sealed, and a fastening device for detachably fastening the vacuum storage device to the first half-shell, the fastening device comprising a first fastening member and a second fastening member, the first half-shell comprising the first fastening member while the vacuum storage device comprises the second fastening member, the first and second fastening members being arranged to cooperate with each other so as to attach the storage device to the first half-shell;

wherein the vacuum storage device further comprises a stiffening plate, said stiffening plate comprising a body and at least one first end section which is inclinable relative to the body, a width of the body being greater than the length of the first end section, wherein the second fastening member comprises the first end section, wherein the first fastening member comprises at least one first holding element cooperating with the first end section so as to maintain the stiffening plate relative to the first half-shell, the first end section extending upward away from the body of the stiffening plate, from the base wall and wherein the first holding element is an elastic band placed on the first lateral wall between the two housings, and wherein the first end section has a length equal or less than the distance separating the two housings such that the first end section is placed over the first lateral wall between the two housings and is slidingly inserted and held between the elastic band and the first lateral wall, a length of the elastic band being greater than the length of the first end section.

* * * * *